US009802438B2

(12) United States Patent
Miranti

(10) Patent No.: US 9,802,438 B2
(45) Date of Patent: Oct. 31, 2017

(54) BOARD BOOK PHOTO ALBUM

(76) Inventor: Laura J. Miranti, Edwardsville, IL (US)

( * ) Notice: Subject to any disclaimer, the term of this patent is extended or adjusted under 35 U.S.C. 154(b) by 1305 days.

(21) Appl. No.: 13/199,556

(22) Filed: Sep. 6, 2011

(65) Prior Publication Data

US 2011/0316266 A1 Dec. 29, 2011

Related U.S. Application Data

(63) Continuation-in-part of application No. 12/152,810, filed on May 16, 2008, now abandoned.

(51) Int. Cl.

| | |
|---|---|
| ***B42D 1/00*** | (2006.01) |
| ***B42D 5/00*** | (2006.01) |
| ***B42D 1/08*** | (2006.01) |
| ***B42F 5/00*** | (2006.01) |
| ***B42D 3/00*** | (2006.01) |
| ***B42F 7/06*** | (2006.01) |
| *B42F 7/02* | (2006.01) |
| *B42F 21/12* | (2006.01) |

(52) U.S. Cl.

CPC ..... *B42F 7/06* (2013.01); *B42D 1/08* (2013.01); *B42F 5/00* (2013.01); *B42F 7/025* (2013.01); *B42F 7/065* (2013.01); *B42F 21/12* (2013.01); *B42P 2201/02* (2013.01)

(58) Field of Classification Search

CPC ... B42D 1/00; B42D 5/00; B42D 1/08; B42D 3/00; B42D 3/12; B42F 5/00; B42F 21/00; B42F 3/00; B42F 13/02; B42F 13/00

USPC ..... 281/3.1, 15.1, 18, 22, 29, 38; 283/37; 402/8, 73, 79

See application file for complete search history.

(56) References Cited

U.S. PATENT DOCUMENTS

| | | | | |
|---|---|---|---|---|
| 2,850,294 | A * | 9/1958 | Ortis | 281/31 |
| 3,797,152 | A * | 3/1974 | Brandt | 402/79 |
| 4,822,195 | A * | 4/1989 | Lu | 402/53 |
| 4,958,855 | A * | 9/1990 | Shipp | 281/45 |
| 5,199,743 | A * | 4/1993 | Rosinski, III | 281/45 |
| 5,437,514 | A * | 8/1995 | Minch | 402/79 |
| 6,139,210 | A * | 10/2000 | Nelson et al. | 402/79 |
| 6,547,472 | B2 * | 4/2003 | Jordan | 402/79 |
| 2006/0261591 | A1 * | 11/2006 | Hewitt et al. | 281/22 |
| 2007/0024046 | A1 * | 2/2007 | Loo | 281/15.1 |
| 2007/0024048 | A1 * | 2/2007 | Akin | 281/22 |
| 2007/0029782 | A1 * | 2/2007 | Alon et al. | 283/37 |
| 2008/0238079 | A1 * | 10/2008 | Whyte | 281/3.1 |

* cited by examiner

*Primary Examiner* — Charles A Fox
*Assistant Examiner* — Justin V Lewis
(74) *Attorney, Agent, or Firm* — Mary J. Gaskin

(57) ABSTRACT

A board book album having stiff pages constructed from layers of white board material and having "hidden pockets," each pocket holding two photographs, back-to-back, that are framed in die cutout openings in each page. Spacers to which the backs of the spreads forming the pages are glued allow each page to accommodate the thickness of the photographs without damaging the outer binding. Each photograph is protected by a piece of clear plastic. Each page can have a small concave notch along its unbound edge in order to allow a user to turn the pages more easily. The cover can have a frame attached thereto for holding a photograph. The album is sturdy enough to be handled by a small child without the photographs being damaged.

18 Claims, 3 Drawing Sheets

BOARD BOOK PHOTO ALBUM

This application is a continuation-in-part of application Ser. No. 12/152,810, which was filed on May 16, 2008. The present invention relates to a board book album for holding photographs which are inserted into pockets formed inside the board book pages.

FIELD OF THE INVENTION

Background of the Invention

Photo albums are typically used to arrange and store photographs for viewing and reviewing. Such albums protect the photographs from the elements, such as light, moisture, and temperature fluctuations. A common example of such a photo album has a hard front cover and a back, cover and holds numerous flexible pages for placement of the photographs. Often the pages are covered with acid-free plastic sheets. The photographs are inserted between the plastic "release sheet" covering the page surface, sometimes on both sides of the page. Such albums are typically bound along the spine. Other photo albums contain plastic "envelopes," each holding one or two photographs (back to back). Each "envelope" is glued, along one edge, to one of the inside covers of the album, so the "envelopes" holding the photographs are layered for "flipping."

Research has shown that children under the age of two need real photographs to help them identify everyday objects. They are unable to associate a drawing or a symbol with a real life object, but they can associate a photograph of an object with the actual object. It would be desirable for a parent to take photographs of people and familiar objects and place them in a photo album for a small child to view, in order to promote object recognition and encourage speech development.

However, the plastic acid-free sheets in many of the presently available albums would not hold up to grabbing, tearing, or drooling of an infant or a young child. The photographs could be ruined, if a child bites, tears, or drools on the sheets. A small child could even destroy the photo album itself, by tearing the pages from the cover binding.

Further, photo albums are often heavy, particularly when the covers are made from leather, plastic, or another sturdy material. The weight of these albums makes them unwieldy and hard for a small child to handle. Sharp corners on the covers and the plastic pages could injure a child.

The prior art discloses several examples of photo albums designed for use by children. U.S. Pat. No. 6,061,943 discloses an album for infants with soft, flexible covers and pages. However, such an album would allow photographs to be bent and mangled, and it is not likely to be used by toddlers and small children. U.S. Pat. No. 5,387,107 shows a story book with pages to which transparent envelopes containing photographs can be attached. However, these can be torn from the surface of the page. U.S. Patent Publication No. U.S. 2006/0261591A1 shows similar adhesive-backed picture pockets which can be attached to rigid pages. Again, the picture pockets could come loose from the pages and the photographs could be damaged or lost. Finally, U.S. Pat. No. 5,816,730 provides a book with blank spaces on the pages to which photographs can be glued. Alternatively, "release sheets" can be used to hold the photographs in place. Once again, a child could easily damage such photographs. None of the albums in the prior art discloses an album with the utility and advantages of the invention disclosed herein.

SUMMARY OF THE INVENTION

The present invention provides a board book album that can withstand less than careful handling by small children and which can hold up to the rigors of being carried and moved frequently. The album is constructed to protect the photographs from being mangled or lost. The pages of the album are easy for children to turn, due to their stiffness and the placement of notches along the open edges of the pages. The albums can also be used by adults who require a sturdy album, or who wish to use it for other purposes, such as scrapbooking.

The board book album has a number of square or rectangular pages. Each page is constructed from two pieces of white board material, the backs of which are glued to a U-shaped spacer disposed therebetween, not to each other. Each of the pages has a square or rectangular die cutout. For instance, for an album holding 4"×6" photographs, the dimensions of the rectangular cutouts will be 3.75"×5.25". The U-shaped spacer is formed to have an opening that is larger than the outer dimensions of the sides and bottom of the of the die cutout, creating a hidden "pocket" between the unglued portions of the backs of the pieces of white board material. An opening, or slot, in the top of each page (between the two pieces of white board material) allows two photographs to be inserted inside each page, back to back. The photographs are arranged so they are framed by the die cutout openings in each page. A rectangular piece of clear plastic is placed in front of each photograph, inside the page, in order to protect the photograph. An opaque rectangular card is placed between the backs of the photographs to separate them.

The adjoining pages of the album are constructed using "spreads", that is, single continuous pieces of white board material, each of which forms the back of one page and the front of the adjoining page, so that no inner binding is required. The outer binding of the pages is typical for that of a board book. In this album, the thickness of the spacer allows each page of the board book to accommodate the addition of two photographs, without damaging the binding or spine of the album.

Each page has a small notch along its "open" edge. These notches are positioned so that, when the album is closed, the notches on the pages are in different locations along the edge of the album, allowing the reader to turn the pages of the board book album more easily.

The corners of the pages are rounded for safety.

The cover of the album can have a raised metal or plastic frame for holding a photograph, which can be slid into the frame through a slot along the top edge of the frame. Alternatively, the front cover can have a die cutout like the rest of the pages, for the display of a photograph.

An object of the present invention is to provide a board book album that can be used by a child.

A further object of the present invention is to provide a sturdy album that can be used by an adult.

Another object of the present invention is to provide a board book album that protects the photographs stored therein.

Yet another object of the present invention is to provide an album that has notched, stiff pages, which are easy to turn.

A still further object of the present invention is to provide a board book album that can accommodate the addition of photographs without damaging the binding.

These and further objects of the present invention will become obvious, as set out in the disclosure contained in the following paragraphs.

DESCRIPTION OF THE PREFERRED EMBODIMENT

Figure 1:
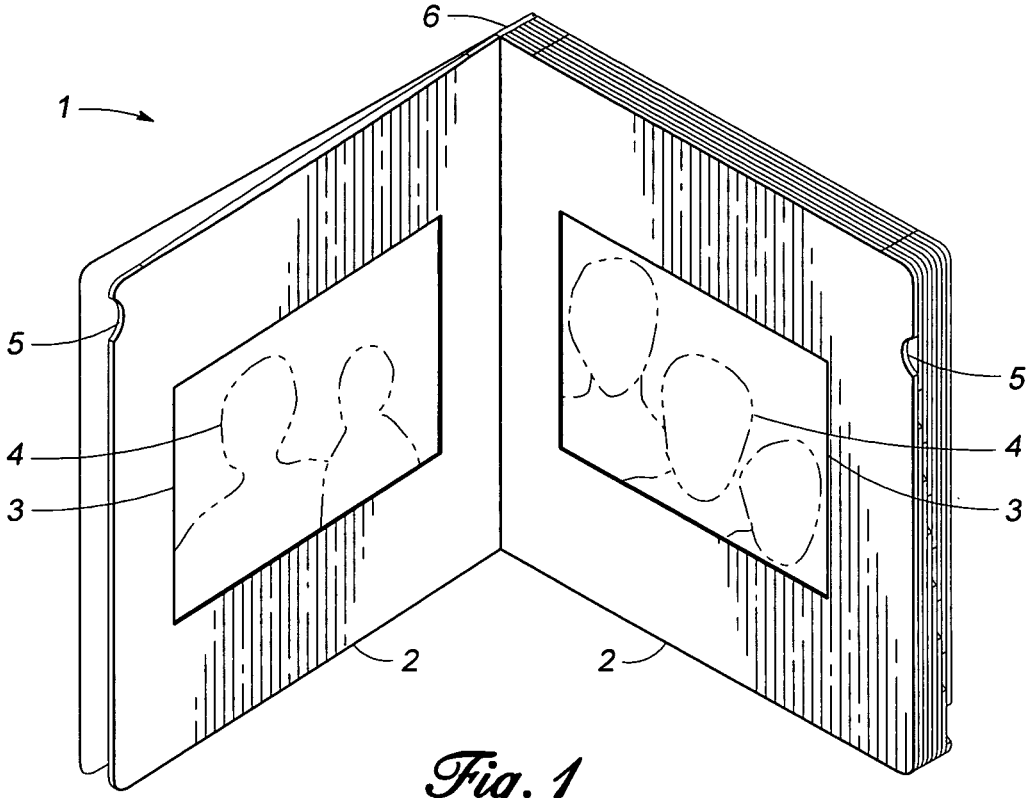
FIG. 1 is a perspective view of the board book album of the present invention, opened to the second page of the album.

As shown in FIG. 1, the board book album 1 of the present invention comprises a number of stiff pages 2, each one having a die cutout 3, the opening sized for the display of a photograph 4. While the shape shown is rectangular, die cutouts 3 can be oval-shaped or heart-shaped, etc., depending on design choice. The die cutouts 3 through each page 2 allow two photographs 4 to be displayed, one on the front and one on the back of each page 2. Each page 2 also can have a notch 5 along the "open" edge of the page 2, the notches 5 positioned so that, when the board book album 1 is closed, the notches 5 are in different locations along the edge of the board book album 1, allowing the viewer to turn the pages of the board book album 1 more easily. The pages 2 are held together at the binding 6. Due to the stiffness of the pages 2, the board book album 1 can be freestanding for display on a flat surface, in either an opened or closed position.

The stiff pages 2 of the board book album 1 are typically constructed from layers of white board material, such as SBS (solid bleached sulfate). Typical white board weights are in the range of 300 to 400 gsm, with an 18 to 25 pt thickness. Another material can be used, so long as it is sturdy and flat, with the same characteristics as white board material. A typical board book album 1 for a child will have ten to twelve pages 2, so that it is not too bulky or heavy for him or her to use. However, the number of pages 2 can vary, depending on its use. The board book album 1 shown is approximately 7"×7" square, with rectangular die cutouts 3 shown with dimensions of 3.75"×5.25" in order to display 4"×6" photographs 4. The die cutouts 3 shown are arranged to hold horizontally-oriented photographs, but the die cutouts 3 can be made in order to display vertically-oriented photographs. A board book album 1 can be made larger for use by older children or adults, or so it can be made with larger cutouts to hold larger photographs. The optional concave notches 5 would be cut approximately one-quarter to one-half inch deep. Such notches 5 function like tabbed dividers for a binder; they facilitate a child's or an elderly adult's ability to turn and separate the pages of his or her board book album 1.

Figure 2:
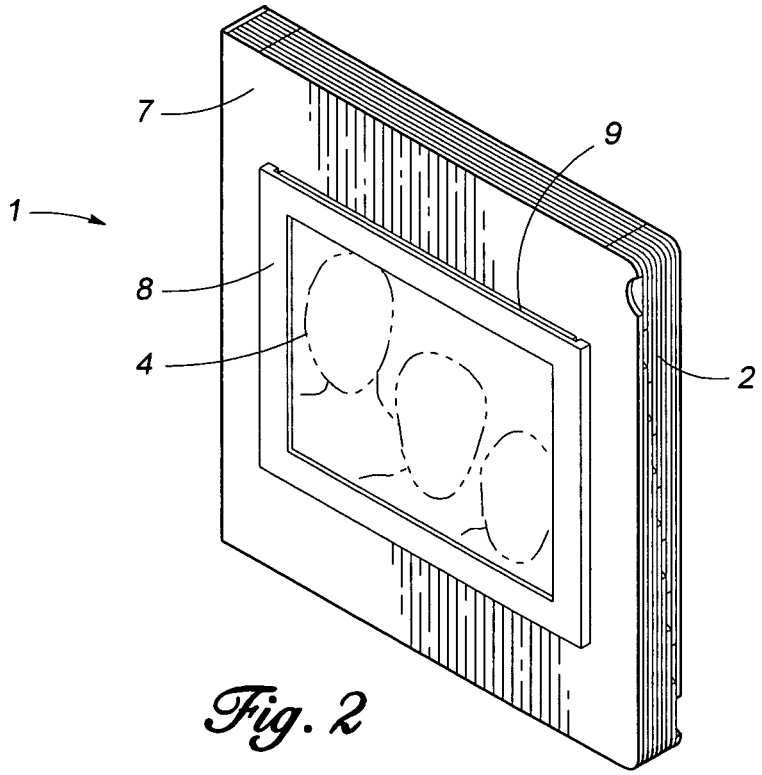
FIG. 2 is a perspective view of the board book album of FIG. 1 in its closed position, showing the cover with a raised frame for holding a photograph.

FIG. 2 shows a closed board book album 1 that has a cover 7 with a rectangular frame 8 for holding a photograph 4 affixed thereon. The cover 7 can be made from white board material, or it can be covered with a decorative material, such as leather, fabric, or plastic. The frame 8, which is made from a rigid plastic or metal, has a transparent plastic window for displaying the photograph 4, as well as a slot 9 along the upper edge for insertion of the photograph 4. Alternatively, the cover 7 can be constructed like any of the other pages 2, as disclosed herein, and a "frame" simply drawn onto the cover 7, around a die cutout.

Figure 3:
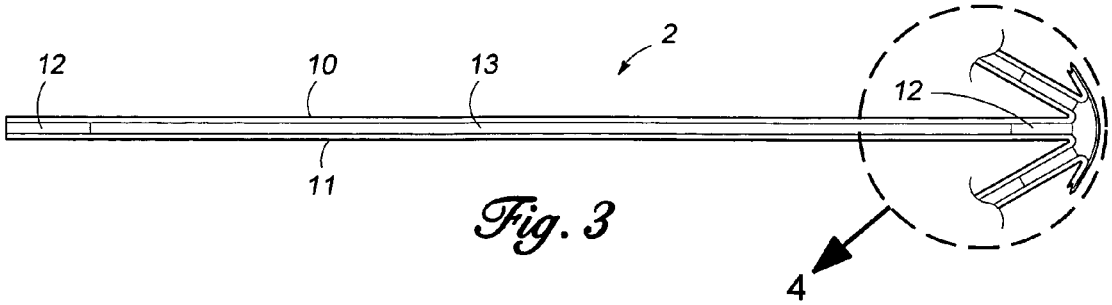
FIG. 3 is a top plan view of a single page of the opened board book album.

As shown in FIG. 3, each page 2 is constructed from one-half of a folded first spread 10 and one-half of a folded second spread 11, both made from white board material. The back of the one-half first spread 10 is aligned with the back of the one-half second spread 11, with a U-shaped spacer 12 therebetween, and the backs are glued to the surfaces of the spacer 12, laving an open slot 13 between the backs. The spacer 12 can also be constructed from white board material, cardboard, or another stiff, sturdy material.

Figure 4:
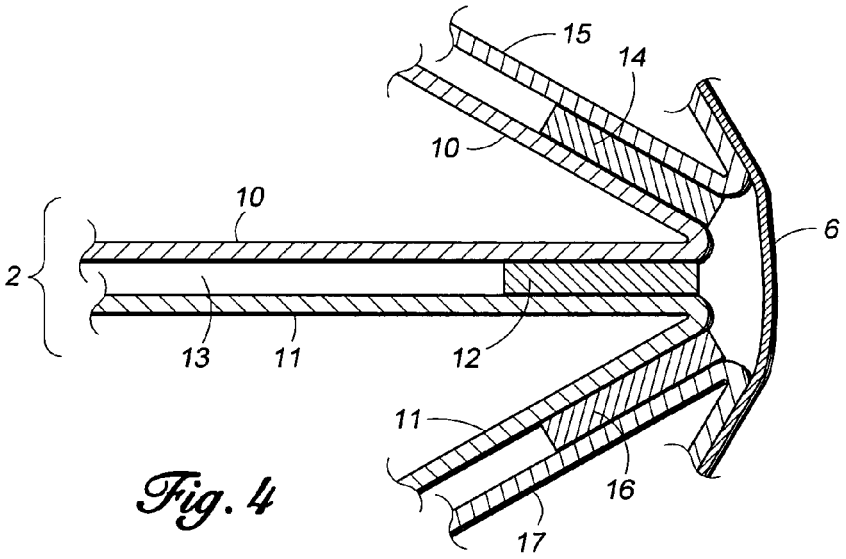
FIG. 4 is an enlarged detail of the single page shown in FIG. 3, as well as its adjoining pages, showing the slot for insertion of two photographs and a portion of the spacers disposed between fronts and backs of each page as part of the binding of the album.

The enlarged detail view of FIG. 4 shows the process for assembling the board book album 1 of the present invention. The spreads 10, 11, 15, and 17 have been folded in half and arranged as shown. For instance, the back of one-half of folded first spread 10 is aligned with the back of one-half of folded second spread 11, and both backs are glued to spacer 12 therebetween, leaving slot 13, which will accommodate two photographs without harming the outer binding 6. Similarly, the back of the other half of first spread 10 is aligned with the back of one-half of folded third spread 15 and both backs are glued to the spacer 14 therebetween. The back of the other half of second spread 11 is aligned with the back of one-half of folded fourth spread 17 and both backs are glued to the spacer 16 therebetween. The process is repeated for the plurality of pages 2 in the album 1.

Figure 5:
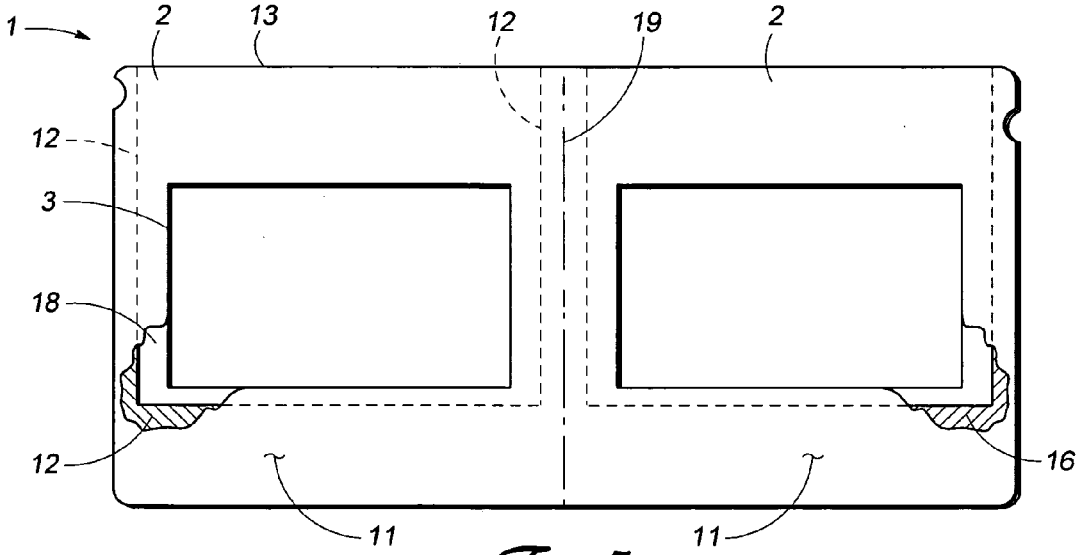
FIG. 5 is a view of an open album, showing the faces of two pages formed from a single spread, with die cut openings in the pages. The dotted lines show the shape of the spacer, as well as the hidden "pockets", each of which will hold two photographs, back to back.

FIG. 5 shows the faces of two adjoining pages 2 of an open board book album 1, with the second spread 11 of a single continuous sheet of white board material forming the back and the front of two adjoining pages 2 of the album 1. The spread 11 has a fold line at 19. The backside of the spread 11 has been glued to U-shaped spacers 12, 16. Each page 2 has a die cutout 3 for display of a photograph (not shown). The dotted lines, which show the inner shape of the spacer 12, 16 define a hidden "pocket" 18 for holding photographs, with an opening or slot 13 along the upper edge of the page 2.

Figure 6:
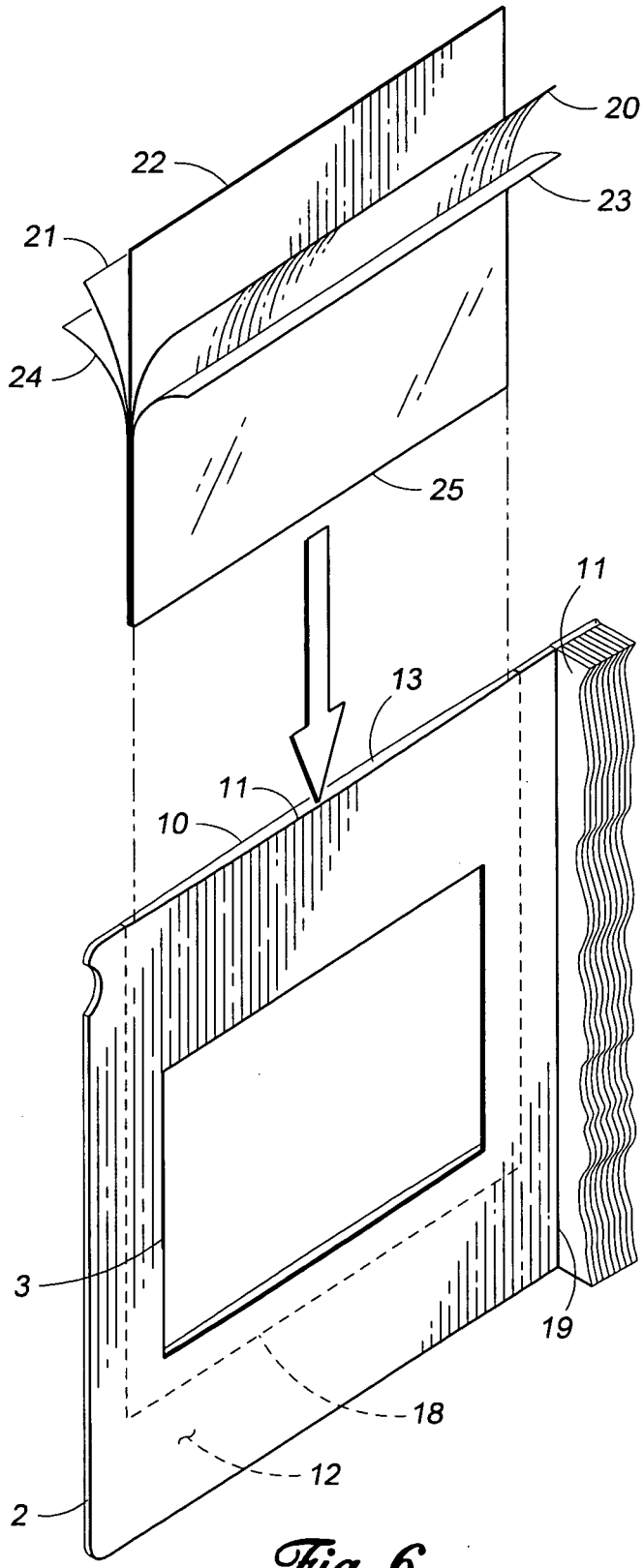
FIG. 6 shows how the photographs and protective pieces of clear plastic are placed into the hidden "pocket" of a single page of the album.

FIG. 6 shows the process for inserting photographs into each of the pages 2 of the board book album 1. Two photographs 20, 21 are arranged back to back, separated by an opaque card 22. Rectangular pieces of clear plastic 23, 24, which can be made from polyethylene terephthalate (PET) or polyvinyl chloride (PVC), for example, are arranged so that each piece covers the front of a photograph 20, 21. Optionally, but not necessarily, the pieces of plastic 23, 24 can be joined at the lower edges 25. As assembled, they are inserted into the opening or slot 13 at the top edge of the page 2 between the back of spread 10 and the back of spread 11 of white board material. Alternatively, the pieces of plastic 23, 24 can be glued to the back spread 11 and the back of spread 10 of white board material, respectively, inside the hidden "pocket" 18 to cover the die cutout 3 opening, and the photographs 20, 21 inserted thereafter. In both cases, the photographs 20, 21 are arranged in the hidden "pocket" 18 so that they can be seen through the die cutout 3 openings on each side of the page 2. The fact that the lower portions of the backs of spreads 10, 11 are glued to the spacer 12 ensures that the photographs 20, 21 remain in position.

Although the board book album of the present invention has been described with reference to preferred embodiments, it will be understood, by those skilled in the art, that additions, modifications, substitutions, deletions and other changes not specifically described are possible, and that the details herein are to be interpreted as illustrative and not as self-limiting.

I claim:

1. A sturdy photo album comprising:

a plurality of stiff pages, each of the pages having a first bound edge, an unbound edge opposite the first bound edge, a lower portion, a central portion having a single die cutout opening, and an upper portion having a slot with an opening along an edge of the upper portion leading to the die cutout opening, each of the pages comprising a first face and a second face, each of the faces formed from one half of a single continuous spread of white board material so that adjoining open pages are formed with a first face and a second face from the continuous spread with a fold line in between the adjoining open pages along the first bound edge, each of the faces further having a backside, each of the pages further comprising a U-shaped stiff spacer disposed between the backside of the first face and the backside of the second face of each page, the spacer being glued to both the backside of corresponding portions of the first face and to the backside of corresponding portions of the second face; and a plurality of pieces of clear plastic for covering the die cutout openings in the pages;

the album being designed for inserting two photographs, back to back, through the opening into the slot in the upper portion of each page and arranging the photographs for viewing through the die cutout opening in each page.

2. The photo album of claim 1 wherein the spacer is made from white board material or cardboard.

3. The photo album of claim 2 wherein the spacer has a thickness sufficient to allow the page to easily accommodate insertion of two photographs into the slot for viewing through the die cutout in each page.

4. The photo album of claim 1 wherein the white board material is solid bleached sulfate in a range of 300 to 400 gsm, with a thickness of 18 to 25 pt.

5. The photo album of claim 1 wherein one of the pieces of clear plastic is placed in front of each of the two photographs before the photographs are inserted into the slot in the upper portion of the page.

6. The photo album of claim 5 which further comprises an opaque card inserted between the two photographs.

7. The photo album of claim 1 wherein one of the pieces of clear plastic is glued to the backside of the first face of the page to cover the die cutout opening, and another of the pieces of clear plastic is glued to the backside of the second face of the page to cover the die cutout opening.

8. The photo album of claim 1 which further comprises a concave notch formed in the unbound edge of each of the pages.

9. A sturdy photo album comprising:

a cover having a frame affixed thereto in a centered position, the frame having a slot for holding a photograph;

a plurality of stiff pages, each of the pages having a first bound edge, an unbound edge opposite the first bound edge, a lower portion, a central portion having a single die cutout opening, and an upper portion having a slot with an opening along an edge of the upper portion leading to the die cutout opening, each of the pages comprising a first face and a second face, each of the faces formed from one half of a single continuous spread of white board material so that adjoining open pages are formed with a first face and a second face from the continuous spread with a fold line in between the adjoining open pages along the first bound edge, each of the faces further having a backside, each of the pages further comprising a U-shaped stiff spacer disposed between the backside of the first face and the backside of the second face of each page, the spacer being glued to both the backside of corresponding portions of the first face and to the backside of corresponding portions of the second face; and a plurality of pieces of clear plastic for covering the die cutout openings in the pages;

the album being designed for inserting a photograph in the frame on the cover of the album and two photographs, back to back, through the opening into the slot in the upper portion of each page and arranging the photographs for viewing through the die cutout openings in each page.

10. The photo album of claim 9 wherein the cover is made a stiff material covered with leather or fabric.

11. The photo album of claim 9 wherein the frame on the cover is made from metal or rigid plastic.

12. The photo album of claim 9 wherein the spacer is made from white board material or cardboard.

13. The photo album of claim 12 wherein the spacer has a thickness sufficient to allow the page to easily accommodate insertion of two photographs into the slot for viewing through the die cutout in each page.

14. The photo album of claim 9 wherein the white board material is solid bleached sulfate in a range of 300 to 400 gsm, with a thickness of 18 to 25 pt.

15. The photo album of claim 9 wherein one of the pieces of clear plastic is placed in front of each of the two photographs before the photographs are inserted into the slot in the upper portion of the page.

16. The photo album of claim 15 which further comprises an opaque card inserted between the two photographs.

17. The photo album of claim 9 wherein one of the pieces of clear plastic is glued to the backside of the first face of the page to cover the die cutout opening, and another of the pieces of clear plastic is glued to the backside of the second face of the page to cover the die cutout opening.

18. The photo album of claim 9 which further comprises a concave notch formed in the unbound edge of each of the pages.

* * * * *